US009759512B1

(12) United States Patent
Keeton et al.

(10) Patent No.: US 9,759,512 B1
(45) Date of Patent: Sep. 12, 2017

(54) STRAP AND RIGID HANDGRIP ASSEMBLY FOR A BOWSTRING RELEASE DEVICE AND METHODS OF USE THEREOF

(71) Applicant: Spot-Hogg Archery Products, Inc., Harrisburg, OR (US)

(72) Inventors: Gary S. Keeton, Hopkinsville, KY (US); Josh J. Johnson, Harrisburg, OR (US)

(73) Assignee: SPOT-HOGG ARCHERY PRODUCTS, INC., Harrisburg, OR (US)

( * ) Notice: Subject to any disclaimer, the term of this patent is extended or adjusted under 35 U.S.C. 154(b) by 0 days.

(21) Appl. No.: 15/052,863

(22) Filed: Feb. 24, 2016

Related U.S. Application Data

(63) Continuation-in-part of application No. 14/144,568, filed on Dec. 31, 2013, now abandoned.

(51) Int. Cl.
*F41B 5/14* (2006.01)

(52) U.S. Cl.
CPC ..... *F41B 5/1469* (2013.01)

(58) Field of Classification Search
CPC ..... F41B 5/1473; F41B 5/1469
See application file for complete search history.

(56) References Cited

U.S. PATENT DOCUMENTS 3,028,852 A 4/1962 Sutton
3,898,974 A 8/1975 Keck
3,954,095 A 5/1976 Lewis
4,066,060 A 1/1978 Napier
4,160,437 A 7/1979 Fletcher
4,232,649 A * 11/1980 Allen ..... F41B 5/1469 124/35.2
4,403,594 A 9/1983 Todd
4,426,989 A 1/1984 Sutton
4,509,497 A 4/1985 Garvison
4,791,908 A 12/1988 Pellis
4,860,720 A * 8/1989 Todd ..... F41B 5/1469 124/35.2
4,969,448 A * 11/1990 Beyer ..... F41B 5/1469 124/35.1

(Continued)

OTHER PUBLICATIONS

Co-owned parent U.S. Appl. No. 14/144,568, filed Dec. 31, 2013 in the name of Keeton.

(Continued)

*Primary Examiner* — Melba Bumgarner
*Assistant Examiner* — Amir Klayman
(74) *Attorney, Agent, or Firm* — David S. Alavi

(57) ABSTRACT

An apparatus includes a wrist strap, a bowstring release device, and a rigid handgrip. The release device is pivotably connected to the wrist strap, and has bowstring retention/release and trigger mechanisms. The handgrip pivots with respect to the wrist strap or release device or both. In a first relative configuration, a grip portion of the handgrip extends transversely away from the release device; in a second relative configuration, the grip portion of the handgrip extends obliquely rearward away from the release device. After drawing the bow by pulling with the wrist strap and handgrip, the trigger can be actuated while continuing to grip the handgrip or after releasing the handgrip (and optionally moving the handgrip to the second relative configuration).

18 Claims, 8 Drawing Sheets

(56) References Cited

U.S. PATENT DOCUMENTS

| | | | | |
|---|---|---|---|---|
| 4,981,128 | A | 1/1991 | Garvison | |
| 5,020,508 | A | 6/1991 | Greene | |
| 5,228,610 | A | 7/1993 | Spence | |
| 5,247,921 | A | 9/1993 | Todd | |
| 5,263,466 | A * | 11/1993 | Peck | F41B 5/1469 124/35.2 |
| 5,323,754 | A | 6/1994 | Pittman et al. | |
| 5,595,167 | A | 1/1997 | Scott | |
| 5,666,936 | A | 9/1997 | Estrada | |
| 5,937,841 | A | 8/1999 | Summers et al. | |
| 6,125,833 | A | 10/2000 | Tentler et al. | |
| 6,205,991 | B1 | 3/2001 | Summers et al. | |
| 6,481,431 | B1 | 11/2002 | Summers | |
| 6,484,710 | B1 | 11/2002 | Summers et al. | |
| 6,895,951 | B2 * | 5/2005 | Summers | F41B 5/1469 124/35.2 |
| 7,284,546 | B2 | 10/2007 | Maki et al. | |
| 7,320,318 | B1 | 1/2008 | Tentler | |
| 8,453,632 | B2 | 6/2013 | Immesberger et al. | |
| 2013/0025578 | A1 | 1/2013 | Jones | |

OTHER PUBLICATIONS

Office action dated Aug. 24, 2015 in parent U.S. Appl. No. 14/144,568.

* cited by examiner

STRAP AND RIGID HANDGRIP ASSEMBLY FOR A BOWSTRING RELEASE DEVICE AND METHODS OF USE THEREOF

BENEFIT CLAIMS TO RELATED APPLICATIONS

This application is a continuation-in-part of U.S. non-provisional application Ser. No. 14/144,568 filed Dec. 31, 2013 in the name of Gary S. Keeton, said application being incorporated by reference as if fully set forth herein.

BACKGROUND

The field of the present invention relates to bowstring release devices used in archery. In particular, various examples of an assembly of a strap and a rigid handgrip for a bowstring release device, and methods of use thereof, are disclosed herein.

A wide variety of bowstring release devices are available for use in archery. Some examples are disclosed in:

- U.S. Pat. No. 3,028,852 entitled "Bow string pulling device for archers" issued Apr. 10, 1962 to Sutton;
- U.S. Pat. No. 3,898,974 entitled "Archery bowstring release" issued Aug. 12, 1974 to Keck;
- U.S. Pat. No. 3,954,095 entitled "Bow string release device" issued May 4, 1976 to Lewis;
- U.S. Pat. No. 4,066,060 entitled "Bow string release device" issued Jan. 3, 1978 to Napier;
- U.S. Pat. No. 4,160,437 entitled "Archery bow string release device" issued Jul. 10, 1979 to Fletcher;
- U.S. Pat. No. 4,403,594 entitled "Bow string release" issued Sep. 13, 1983 to Todd;
- U.S. Pat. No. 4,426,989 entitled "Bow string release" issued Jan. 24, 1984 to Sutton;
- U.S. Pat. No. 4,509,497 entitled "Bowstring release mechanism" issued Apr. 9, 1985 to Garvison;
- U.S. Pat. No. 4,791,908 entitled "Bowstring release mechanism" issued Dec. 20, 1988 to Pellis;
- U.S. Pat. No. 4,860,720 entitled "Bow string release device" issued Aug. 29, 1989 to Todd;
- U.S. Pat. No. 4,981,128 entitled "Arrow release device" issued Jan. 1, 1991 to Garvison;
- U.S. Pat. No. 5,020,508 entitled "Apparatus for selectively releasing a bowstring of an archery bow" issued Jun. 4, 1991 to Greene;
- U.S. Pat. No. 5,228,610 entitled "Wrist support for hand-held devices" issued Jul. 20, 1993 to Spence;
- U.S. Pat. No. 5,247,921 entitled "Archery bowstring release device" issued Sep. 28, 1993 to Todd;
- U.S. Pat. No. 5,323,754 entitled "Strap assembly for bow string release mechanism" issued Jun. 28, 1994 to Pittman et al;
- U.S. Pat. No. 5,595,167 entitled "Secure archery wrist strap" issued Jan. 21, 1997 to Scott;
- U.S. Pat. No. 5,666,936 entitled "Ergonomic inertia bowstring release" issued Sep. 16, 1997 to Estrada;
- U.S. Pat. No. 5,937,841 entitled "Wrist strap connector for a bowstring release" issued Aug. 17, 1999 to Summers et al;
- U.S. Pat. No. 6,125,833 entitled "Wrap around bow string release strap" issued Oct. 3, 2000 to Tentler et al;
- U.S. Pat. No. 6,205,991 entitled "Bowstring release with adjustable trigger" issued Mar. 27, 2001 to Summers et al;
- U.S. Pat. No. 6,481,431 entitled "Bowstring release glove" issued Nov. 19, 2002 to Summers;

- U.S. Pat. No. 6,484,710 entitled "Archery finger trigger release with cocking slide" issued Nov. 26, 2002 to Summers et al;
- U.S. Pat. No. 7,284,546 entitled "Archer's glove for use with a bow string release" issued Oct. 23, 2007 to Maki et al;
- U.S. Pat. No. 7,320,318 entitled "Strap for bow string release" issued Jan. 22, 2008 to Tentler;
- U.S. Pat. No. 8,453,632 entitled "Bowstring drawing and release assist apparatus and method thereof" issued Jun. 4, 2013 to Immesberger et al; and
- U.S. Pub. No. 2013/0025578 entitled "Archery release" published Jan. 31, 2013 in the name of Jones.

Each of the preceding patents or applications is incorporated by reference as if fully set forth herein.

A typical archery release aid, including many of those disclosed in the preceding references, include a mechanical bowstring release device with a bowstring retention/release mechanism and a trigger mechanism operatively coupled to the retention/release mechanism. The bowstring retention/release mechanism can include jaws, one or more hooks, or other similar structure for retaining a bowstring, either directly or, more typically, indirectly by retaining a D-shaped loop attached to the bowstring (i.e., a so-called release loop); for the purposes of the present disclosure and appended claims, "retaining" or "engaging" the bowstring shall encompass both direct and indirect retention or engagement of the bowstring. The release device is usually attached to some type of strap, grip, glove, or similar structure that enables an archer to pull on the release device to pull the bowstring to draw the bow. Once the bow is drawn and aimed, the archer can actuate the trigger mechanism to release the bowstring (e.g., by opening a pair of jaws) and shoot the bow. Release aids can be advantageous for reasons that can include but are not limited to one or more of: tension on the bowstring is exerted on the retention/release mechanism instead of the archer's fingers; the retention/release mechanism can release the bowstring without introducing inadvertent lateral or vertical motion to the bowstring or arrow; the trigger can be actuated with minimal movement of the archer's hand or fingers; the force needed to draw the bow is distributed over a larger portion of the archer's fingers, hand, or wrist instead or being concentrated at the fingertips.

SUMMARY

A bowstring draw/release apparatus comprises a wrist strap, a bowstring release device, and a handgrip. The wrist strap includes a dorsal-wrist portion and a heel portion. The bowstring release device is pivotably connected at a rearward end thereof to the heel portion of the wrist strap. The release device has a bowstring retention/release mechanism at its forward end and a trigger mechanism operationally coupled to the retention/release mechanism. The handgrip has substantially rigid grip and coupler portions that are substantially rigidly connected to each other; the handgrip is pivotably connected at a rearward end of the coupler portion to the release device or the heel portion of the wrist strap. A pivotable connection of the release device to the heel portion of the wrist strap is structurally arranged so as to enable the release device to pivot relative to the wrist strap with the wrist strap engaged about a user's wrist. A pivotable connection of the handgrip to the release device or the heel portion of the wrist strap is structurally arranged so as to enable the handgrip to pivot relative to the release mechanism or the wrist strap or both with the wrist strap engaged about a user's wrist. The grip portion of the handgrip is connected to the bowstring draw/release apparatus only by connection of said grip portion to the coupler portion of the handgrip. With the wrist strap, the release device, and the handgrip in a first relative configuration, the grip portion of the handgrip extends transversely away from the release device; with the wrist strap, the release device, and the handgrip in a second relative configuration, the grip portion of the handgrip extends obliquely rearward away from the release device.

A method for using an archery bow using the bowstring draw/release apparatus comprises: (A) placing on the user's wrist the wrist strap; (B) engaging a bowstring of the archery bow with the bowstring release device; (C) arranging in the first relative configuration the wrist strap, the release device, and the handgrip; (D) grasping the release device and the handgrip; (E) pulling the bowstring with the wrist strap and the handgrip to draw the bow; and (F) with the bow drawn, removing at least one finger from the grip portion of the handgrip and, using that finger, actuating the trigger mechanism.

In some examples, the method further comprises, with the bow drawn, removing at least one finger from the handgrip and, using that finger, actuating the trigger mechanism while leaving at least one other finger grasping the handgrip. In some other examples, the method further comprises, with the bow drawn: removing all fingers from the handgrip; using at least one finger to move the handgrip to the second relative configuration; and using at least one finger to actuate the trigger mechanism. In some such examples, with the handgrip in the second relative configuration, the wrist strap, the release device, and the handgrip are arranged so that the user can actuate the trigger mechanism without making contact with the handgrip.

Objects and advantages pertaining to bowstring draw/release apparatus and methods may become apparent upon referring to the exemplary embodiments illustrated in the drawings and disclosed in the following written description or appended claims.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

It should be noted that the examples depicted in this disclosure are shown only schematically, and that not all features may be shown in full detail or in proper proportion. Certain features or structures may be exaggerated relative to others for clarity. It should be noted further that the drawings illustrate only examples, and should not be construed as limiting the scope of the written description or appended claims.

DETAILED DESCRIPTION OF EMBODIMENTS

Figure 1:
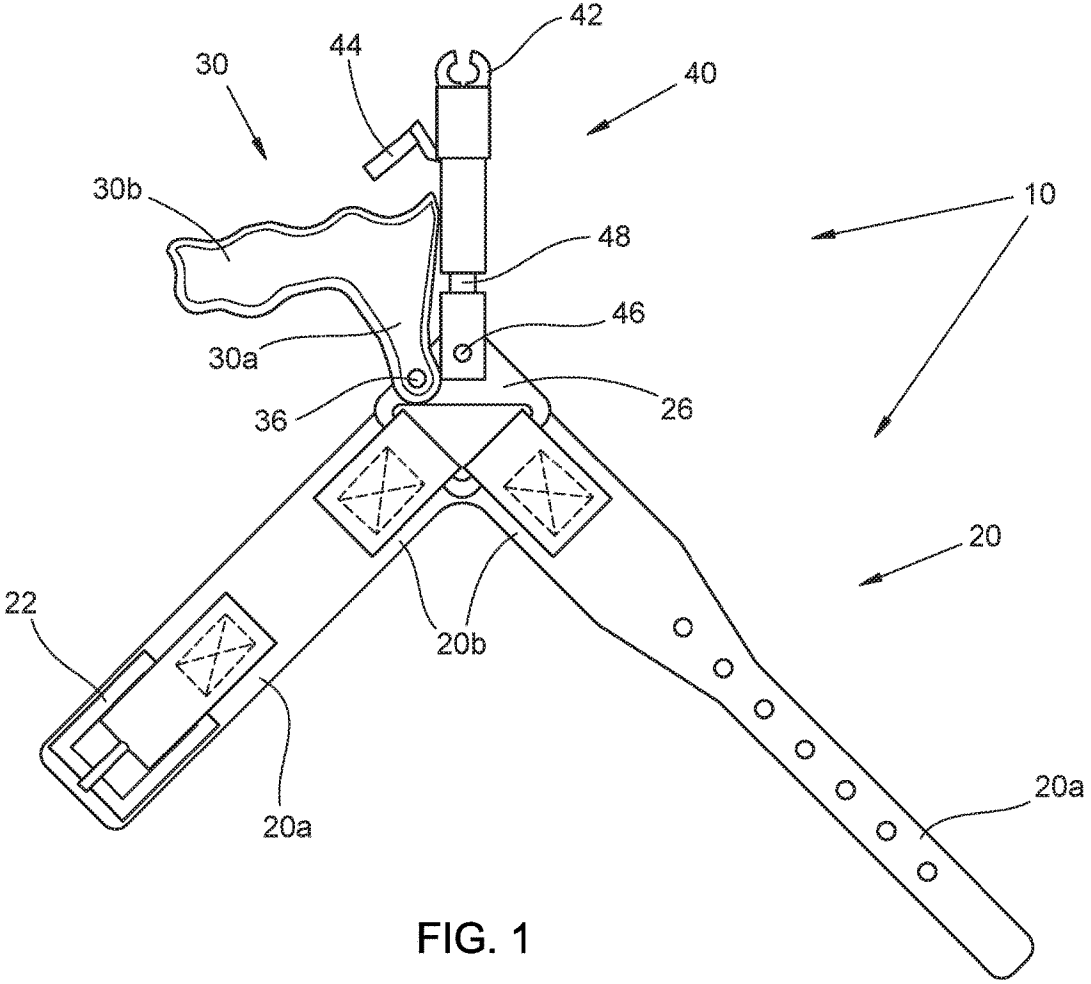
FIG. 1 is a schematic bottom view of a first example of a bowstring draw/release apparatus (arranged for a right-handed archer) comprising a wrist strap, a handgrip, and a bowstring release device in a first relative configuration.
Figure 2:
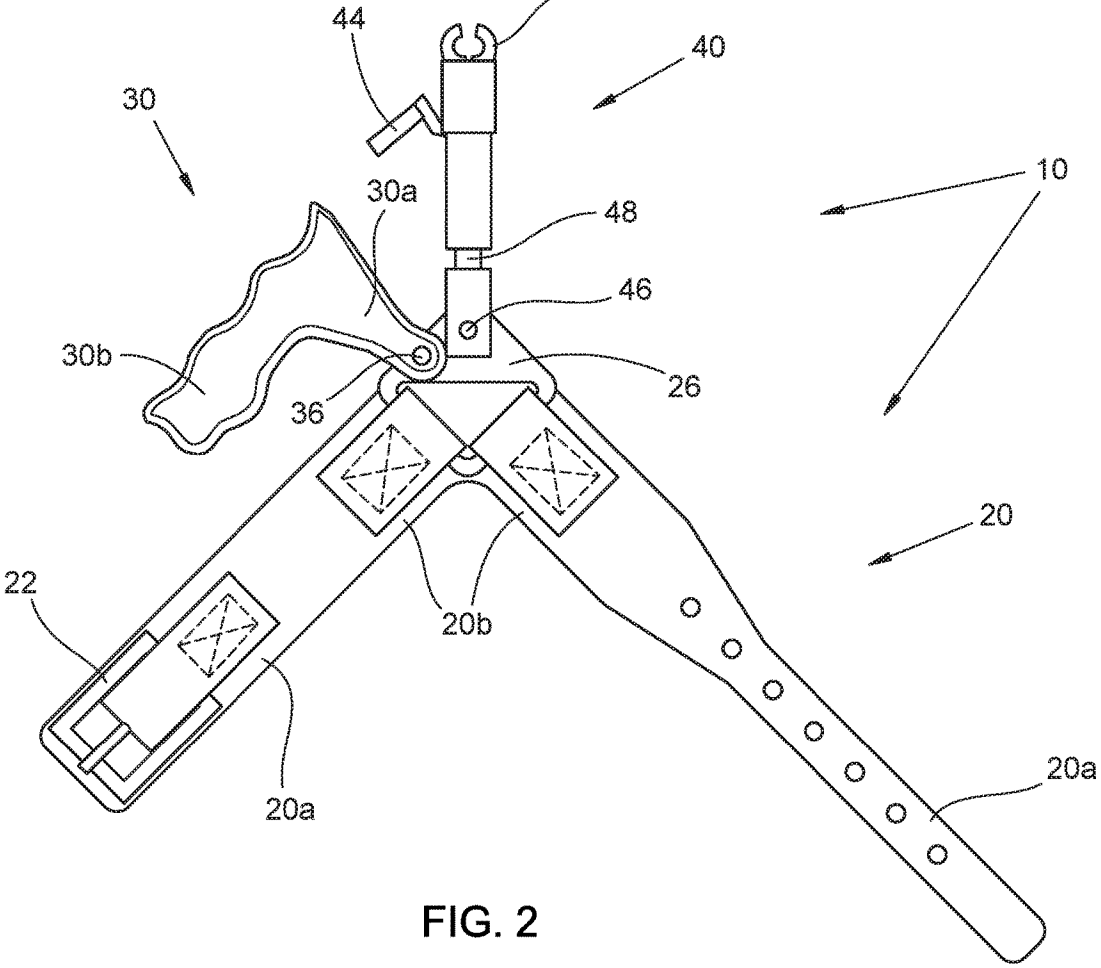
FIG. 2 is a schematic bottom view of the example of FIG. 1 in a second relative configuration.

A first example of a bowstring draw/release apparatus 10 is illustrated schematically in FIGS. 1 and 2 and comprises a wrist strap 20, a handgrip 30, and a bowstring release device 40. The wrist strap 20 includes a dorsal-wrist portion 20*a* and a heel portion 20*b*; those are typically contiguous with each other. When the apparatus is in use, the wrist strap 20 is wrapped around the archer's (i.e., user's) wrist (typically of the archer's dominant hand, used for drawing the bow) with the dorsal-wrist portion 20*a* against the dorsal surface of the archer's wrist and with the heel portion 20*b* against the heel of the archer's hand (i.e., a proximal portion of the archer's palm). The wrist strap 20 can comprise a strip of any suitably strong, flexible material; examples can include but are not limited to leather, canvas, ballistic nylon, and so forth. To facilitate placement on and removal from the archer's wrist, the dorsal-wrist portion 20*a* typically is divided into separate strap segments that are joined by a closure mechanism 22, e.g., a buckle or clasp, snaps or buttons, hook-and-loop type fasteners, and so forth. A buckle is shown attached to the wrist strap 20 by a stitched loop of wrist strap material in the example of FIGS. 1 and 2; any suitable closure mechanism can be employed and can be attached in any suitable way. One example of a suitable arrangement of the wrist strap 20 is an L-shaped strip (as in the example of FIGS. 1 and 2), with the heel portion 20*b* of the wrist strap being the portion that includes the angled bend in the L-shaped strip and the separate strap segments of the dorsal-wrist portion 20*a* being positioned at the ends of the L-shape. The angled bend of the L-shape allows the heel portion 20*b* to extend somewhat onto the heel of the hand (i.e., onto a proximal portion of the user's palm) while the dorsal-wrist portion 20*a* wraps around the dorsal surface of the user's wrist.

In the first example, the handgrip 30 and the release device 40 are connected to the heel portion 20*b* of the wrist strap 20. The bowstring release device 40 is pivotably connected at its rearward end to the heel portion 20*b* of the wrist strap 20, and has a bowstring retention/release mechanism 42 at it forward end. In the example of FIGS. 1 and 2 the retention/release mechanism 42 includes a pair of opposed jaws; any suitable jaws, hook(s), or other structure can be employed as the retention/release mechanism 42, including those disclosed in the references cited above. The release device 40 also includes a trigger mechanism operationally coupled to the retention/release mechanism 42. In the example of FIGS. 1 and 2 the trigger mechanism includes a transverse trigger lever 44. User actuation of the trigger mechanism releases the bowstring and shoots the arrow from the drawn bow. Any suitable trigger mechanism can be employed, including those disclosed in the references cited above.

The rearward end of the release device 40 is pivotably connected to the heel portion 20*b* of the wrist strap 20 so as to enable the release device 40 to pivot relative to the wrist strap 20. That pivoting of the release device reduced or eliminates transmission of torque or transverse forces from the wrist strap 20 or the handgrip 30 to the bowstring. Any suitable type of pivotable connection can be employed, e.g., hinge, ball-and-socket, clevis-and-pin, axle (with or without one or more bearings), or combinations. In the examples of FIGS. 1 and 2, a pin 46 passes through the rearward end of the release device 40 and through a metal plate 26 in a clevis-and-pin arrangement that permits sideways pivoting (i.e., yaw) of the release device 40 relative to the wrist strap 20. The metal plate 26 is attached in this example by a pair of stitched loops of wrist strap material to the heel portion 20*b* of the wrist strap 20; any suitable attachment can be employed. Shaft 48 connecting forward and rearward portions of the release device 40 permits rotation of the release device 40 about a longitudinal axis (i.e., roll).

The handgrip 30 has substantially rigid grip and coupler portions 30*a* and 30*b*, respectively, that are substantially rigidly connected to each other. Because no real substance or material is absolutely rigid, for purposes of the present disclosure and appended claims, "substantially rigid" shall denote sufficient rigidity that the handgrip 30 is functionally equivalent to a hypothetical, absolutely rigid handgrip, i.e., any slight bending, flexing, or deformation of the handgrip 30 does not alter its functioning in the context of the bowstring draw/release device 10. Any suitably strong, substantially rigid one or more materials can be employed for forming the handgrip 30, including but not limited to: machined, cast, molded, or otherwise shaped metal; high-density plastic; wood; and so forth. The coupler portion 30*a* and the grip portion 30*b* can comprise assembled parts or preferably can comprise a single, integrally formed member. In the example of FIGS. 1 and 2, the coupler portion 30*a* and the grip portion 30*b* comprise distinct portions of an integrally formed, L-shaped handgrip 30; in other examples (not shown) the delineation between the coupler portion 30*a* and the grip portion 30*b* may not be so pronounced. The coupler portion 30*a* of the handgrip 30 is pivotably connected to the heel portion 20*b* of the wrist strap 20 in the example of FIGS. 1 and 2; alternatively, the coupler portion 30*a* can be pivotably connected to the release device 40.

In the example shown in FIGS. 1 and 2 a pivotable connection is employed between the coupler portion 30*a* of the handgrip 30 and the heel portion 20*b* of the wrist strap 20. That pivotable connection (along with the pivotable connection of the release device 40 to the heel portion 20*b*) is structurally arranged so as to enable the handgrip 30 to pivot relative to the wrist strap 20 or the release device 40 or both. The grip portion 30*b* of the handgrip 30 is connected to the wrist strap 20 only by its connection to the coupler portion 30*a*, i.e., the connection between the coupler portion 30*a* and the heel portion 20*b* is the only connection between the handgrip 30 and the wrist strap 20. Any suitable type of pivotable connection can be employed, e.g., hinge, ball-and-socket, clevis-and-pin, axle (with or without one or more bearings), or combinations. In the examples of FIGS. 1 and 2, a pin 36 passes through the rearward end of the coupler portion 30*a* of the handgrip 30 and through the metal plate 26 attached to the heel portion 20*b* of the wrist strap 20 in a clevis-and-pin arrangement that permits sideways pivoting (i.e., yaw) of the handgrip 30 relative to the wrist strap 20.

Figure 3:
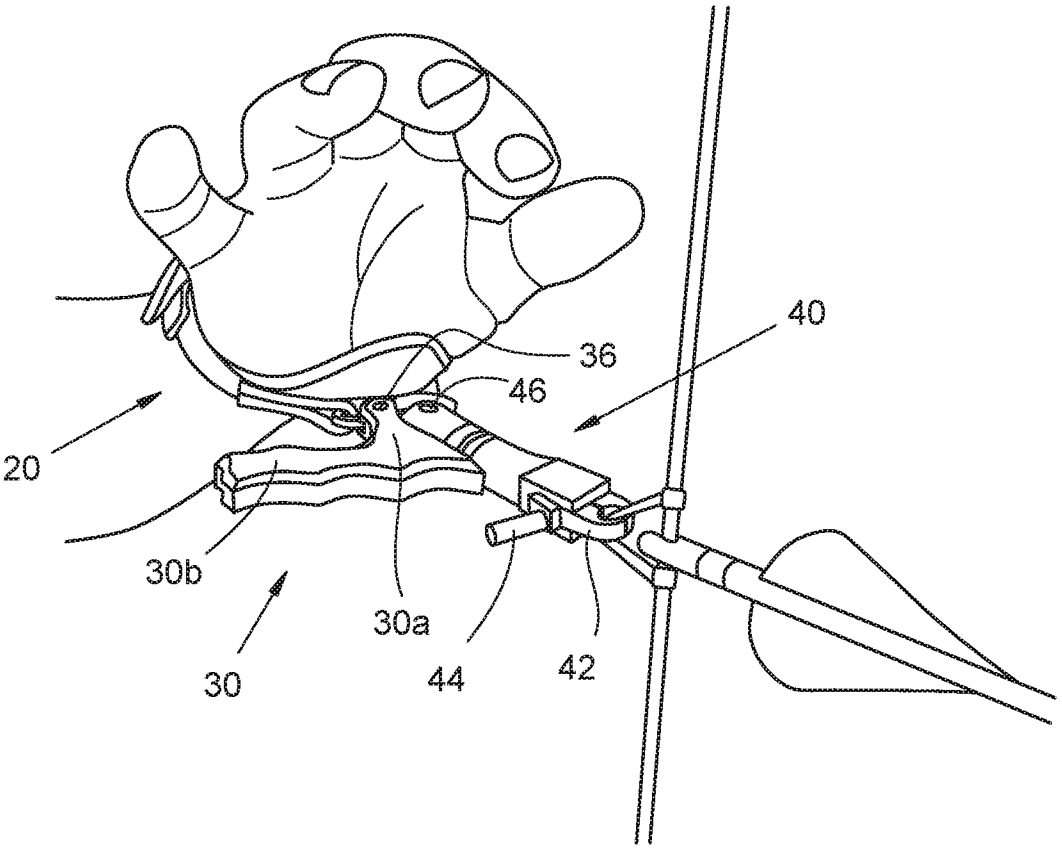
FIG. 3 is a schematic view perspective view of the example of FIG. 1 on a user's wrist, in the first relative configuration, engaging an undrawn bowstring, and before the handgrip is grasped by the user.
Figure 4:
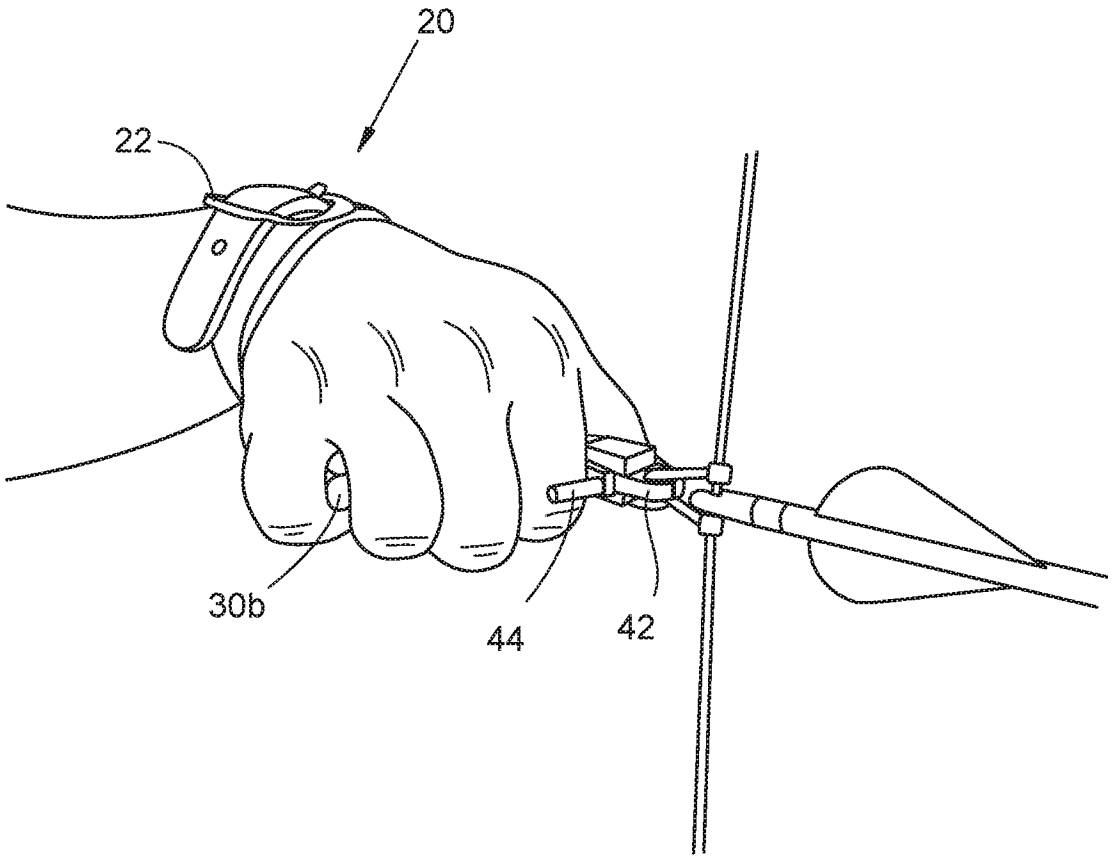
FIG. 4 is a schematic view perspective view of the example of FIG. 1 on the user's wrist, in the first relative configuration, engaging the undrawn bowstring, and with the handgrip grasped by the user.

In a first relative configuration (as in FIG. 1), the wrist strap 20, the release device 40, and the handgrip 30 are arranged so that the grip portion 30*b* of the handgrip 30 abuts and extends transversely away from the release device 40. "Transversely" in this context shall denote an angle between the grip portion 30*b* and the release device 40 greater than about 75° up to 90° (i.e., roughly perpendicular to the release device 40). In that first relative configuration, and with the wrist strap 20 on the user's wrist, the wrist strap 20, the release device 40, and the handgrip 30 are arranged so that one or more of the user's fingers can grasp the grip portion 30*b* of the handgrip 30. For purposes of the present disclosure and appended claims, "finger(s)" shall designate one or more of the index, middle, ring, or little fingers of the user's hand, but shall exclude the user's thumb. FIG. 3 illustrates schematically the user's hand before grasping the grip portion 30*b* of the handgrip 30. FIG. 4 illustrates schematically the user's hand grasping the grip portion 30*b* of the handgrip 30 using his index, middle, and ring fingers while the release device 40 extends forward between the user's thumb and index finger. The use of the user's index, middle, and rings fingers to grasp the grip portion 30*b* of the handgrip 30, and corresponding sizing and arrangement of the grip portion 30*b* to accommodate those three fingers, is a preferred example. However, to accommodate various user sizes or preferences, alternative arrangements or sizing can be employed to enable use of one, two, three, or four fingers for grasping the grip portion of the handgrip 30.

Figure 6:
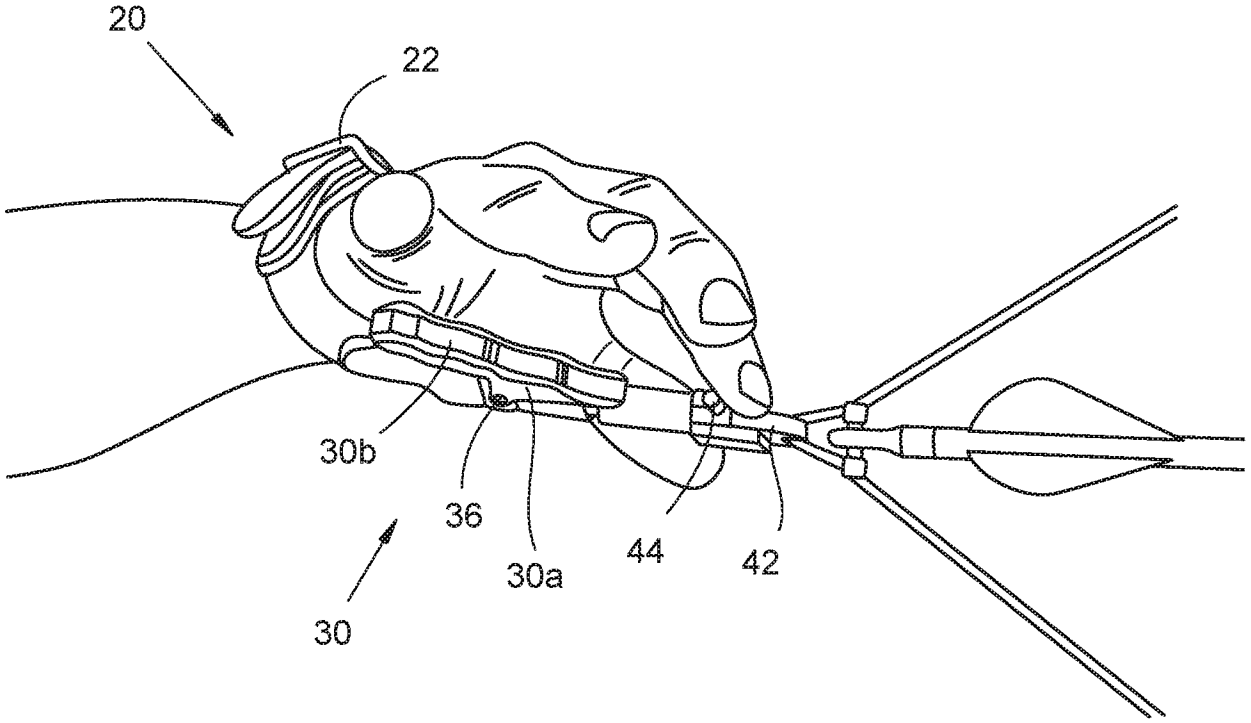
FIG. 6 is a schematic view perspective view of the example of FIG. 1 on the user's wrist, in the second relative configuration, engaging the drawn bowstring, and with the handgrip having been ungripped by the user.

The pivotable connection of the coupler portion 30*a* of the handgrip 30 to the heel portion 20*b* of the wrist strap 20 is structurally arranged so as to enable the handgrip 30 to pivot relative to the wrist strap 20 between (i) the first relative configuration of the wrist strap 20, the release device 40, and the handgrip 30 (as in FIG. 1) and (ii) a second relative configuration of the wrist strap 20, the release device 40, and the handgrip 30 (as in FIG. 2). With the wrist strap 20, the release device 40, and the handgrip 30 in the second relative configuration, the grip portion 30*b* of the handgrip 30 is spaced apart from the release device 40 and the grip portion 30*b* extends obliquely rearward away from the release device 40. "Obliquely" in this context shall denote an angle between the grip portion 30*b* and the release device 40 less than about 60°, or in some instance less than about 55° or less than about 50°. That arrangement of the second configuration enables, e.g., the user to actuate the trigger mechanism without making contact with the grip portion 30*b* of the handgrip 30 (as in FIG. 6).

Figure 7:
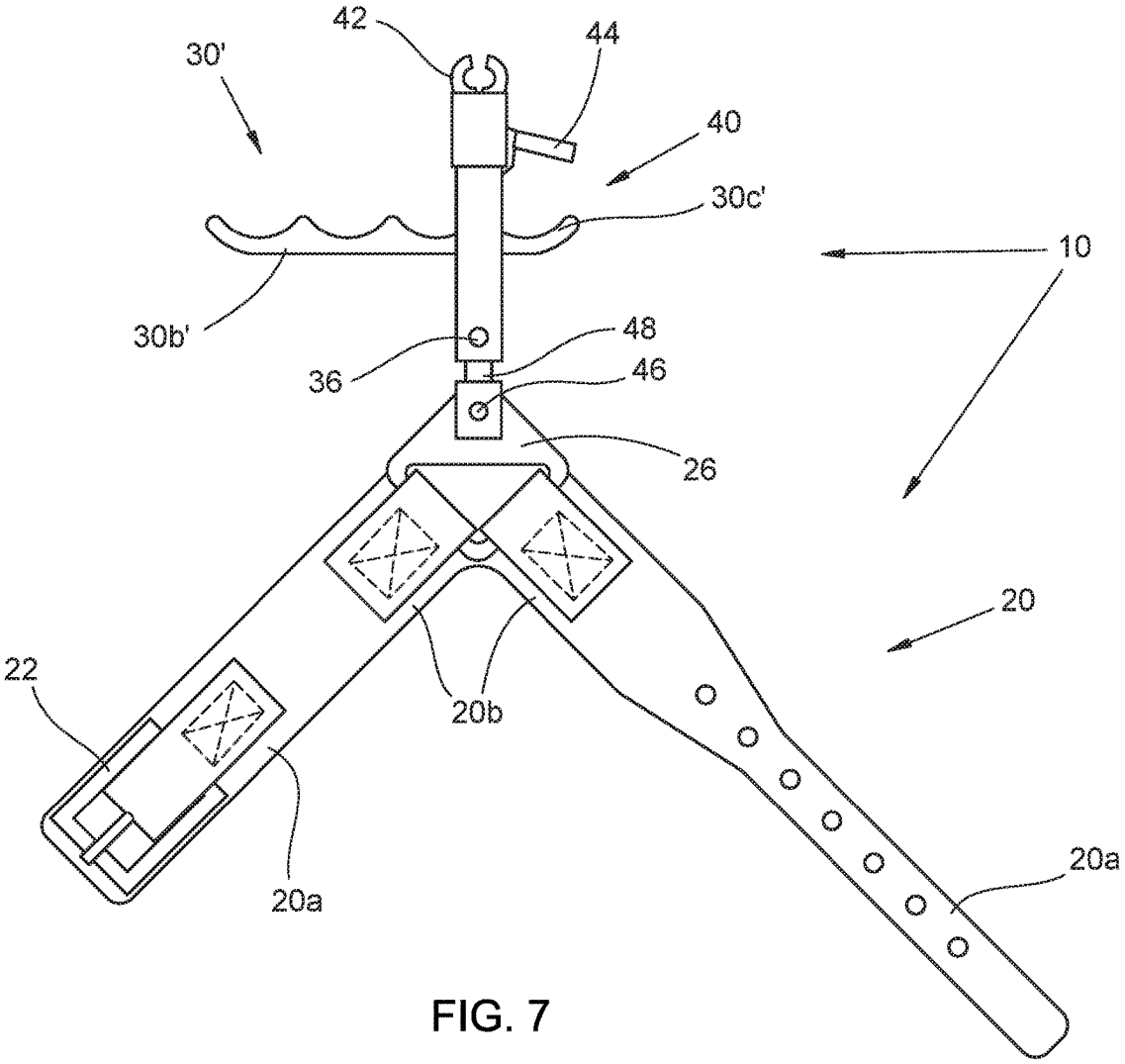
FIG. 7 is a schematic bottom view of a second example of a bowstring draw/release apparatus (arranged for a right-handed archer) comprising a wrist strap, a handgrip, and a bowstring release device in a first relative configuration.
Figure 8:
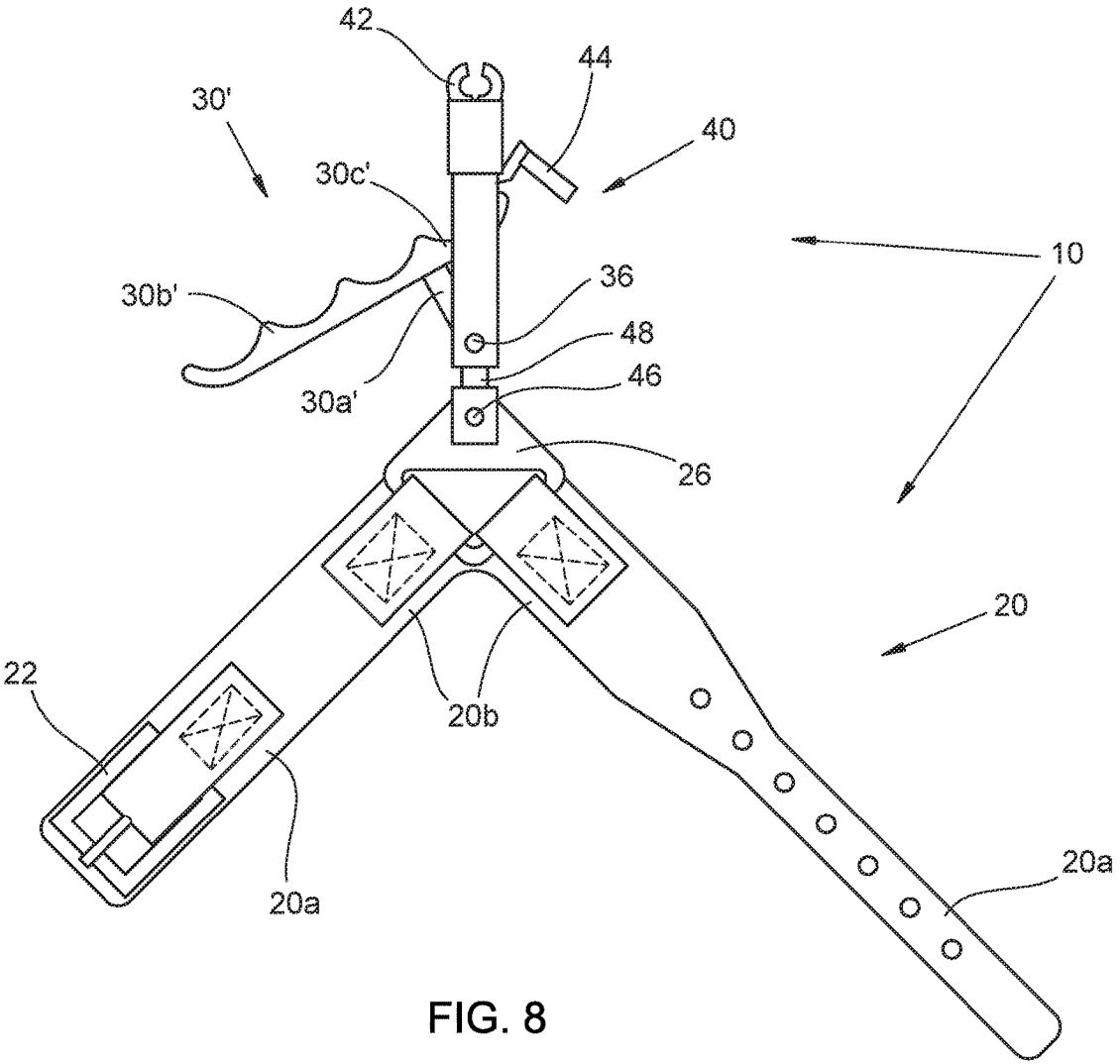
FIG. 8 is a schematic bottom view of the example of FIG. 8 in a second relative configuration.

A second example of a bowstring draw/release apparatus 10 is illustrated schematically in FIGS. 7 and 8 and includes a handgrip 30' arranged differently from the handgrip 30 of the first example; the wrist strap 20 and the bowstring release device 40 are substantially similar to the first example. In the example of FIGS. 7 and 8, the coupler portion 30*a*' and the grip portion comprise distinct portions of an integrally formed, asymmetric T-shaped handgrip 30'; the grip portion includes lateral grip portion 30*b*' and a medial grip portion 30*c*' (medial and lateral terminology referring to directions toward and away from the archer, respectively, when the bow is drawn by the archer). In other examples (not shown) the delineation between the coupler portion 30*a*' and the grip portions 30*b*'/30*c*' may not be so pronounced. The coupler portion 30*a*' of the handgrip 30' is pivotably connected to the release device 40 in the example of FIGS. 7 and 8; alternatively, the coupler portion 30*a*' can be pivotably connected to heel portion 20*b* of the wrist strap 20.

In the example shown in FIGS. 7 and 8 a pivotable connection is employed between the coupler portion 30*a*' of the handgrip 30' and the release device 40. That pivotable connection (along with the pivotable connection of the release device 40 to the heel portion 20*b*) is structurally arranged so as to enable the handgrip 30' to pivot relative to the wrist strap 20 or the release device 40 or both. The grip portions 30*b*'/30*c*' of the handgrip 30 are connected to the wrist strap 20 only by their connection to the coupler portion 30*a*', i.e., the connection between the coupler portion 30*a*' and the release device 40 is the only connection between the handgrip 30' and the wrist strap 20. Any suitable type of pivotable connection can be employed, e.g., hinge, ball-and-socket, clevis-and-pin, axle (with or without one or more bearings), or combinations. In the examples of FIGS. 7 and 8, a pin 36 passes through the rearward end of the coupler portion 30*a*' of the handgrip 30' and through the release device 40 in a clevis-and-pin arrangement that permits sideways pivoting (i.e., yaw) of the handgrip 30' relative to the release device 40 and the wrist strap 20.

In a first relative configuration (as in FIG. 7), the wrist strap 20, the release device 40, and the handgrip 30' are arranged so that a medial grip portion 30*c*' of the handgrip 30' extends transversely away from the release device 40 on a first side of the release device 40, and a lateral grip portion 30*b*' of the handgrip 30' extends transversely away from the release device 40 on a second side of the release device 40 opposite its first side. In that first relative configuration, and with the wrist strap 20 on the user's wrist, the wrist strap 20, the release device 40, and the handgrip 30 are arranged so that the user's index finger can grasp the medial grip portion 30*c*' and one or more of the user's other fingers can grasp the lateral grip portion 30*b*'; the release device 40 extends forward between the user's index and middle fingers. The use of all of the user's four fingers to grasp the grip portions 30*b*'/30*c*' of the handgrip 30', and corresponding sizing and arrangement of the grip portions 30*b*'30*c*' to accommodate the fingers, is a preferred example. However, to accommodate various user sizes or preferences, alternative arrangements or sizing can be employed to enable use of two, three, or four fingers for grasping the grip portions 30*b*'/30*c*' of the handgrip 30'.

The pivotable connection of the coupler portion 30*a*' of the handgrip 30' to the release device 40 is structurally arranged so as to enable the handgrip 30' to pivot relative to the wrist strap 20 between (i) the first relative configuration of the wrist strap 20, the release device 40, and the handgrip 30' (as in FIG. 7) and (ii) a second relative configuration of the wrist strap 20, the release device 40, and the handgrip 30' (as in FIG. 8). With the wrist strap 20, the release device 40, and the handgrip 30' in the second relative configuration, the lateral grip portion 30*b*' and at least part of the medial grip portion 30*c*' extend obliquely rearward away from the release device 40 on the second side of the release device 40. That arrangement of the second configuration enables, e.g., the user to actuate the trigger mechanism without making contact with the grip portions 30*b*'/30*c*' of the handgrip 30'.

In some examples, the grip portion 30*b* of the handgrip 30 (or grip portions 30*b*'/30*c*' of handgrip 30') includes one or more depressions or scallops on a forward edge thereof that are structurally arranged so as to receive in each of the one or more depressions a corresponding finger of the user's hand. Three such depressions are shown in the example of FIGS. 1 and 2, in which the handgrip 30 also has beveled edges to more readily conform to the user's hand; four such depression are shown in the example of FIGS. 7 and 8. In some examples (not shown) the grip portion 30*b* of the handgrip 30 (or grip portions 30*b*'/30*c*' of handgrip 30') includes padding material.

The rigidity of the handgrip 30/30' is a feature that distinguishes the presently disclosed apparatus and methods from prior release aids and corresponding methods. Several prior release aids include portions that are grasped by the user's fingers (see, e.g., U.S. Pat. No. 5,323,754 to Pittman and U.S. Pat. No. 6,481,431 to Summers, cited above). However, in those prior examples, the grip portion is a flexible member (typically the same material as the wrist strap) that wraps around the user's hand. Because those prior grip members are flexible, they require multiple attachment points to the wrist strap to remain in proper position for use, and they also can only transmit force while under tension. The rigid handgrip 30/30', in contrast, only requires a single attachment to the wrist strap (and in fact would not function as intended with more than a single attachment); its rigidity enables it to remain in proper position for use; it can transmit force under tension or compression. These advantages enable the archer to employ various hand, wrist, arm, or shoulder positions while drawing the bow or while holding the drawn bow, thereby allowing different arm or shoulder muscles to come into play while drawing the bow or holding the bow at full draw while aiming or waiting to shoot.

Figure 5:
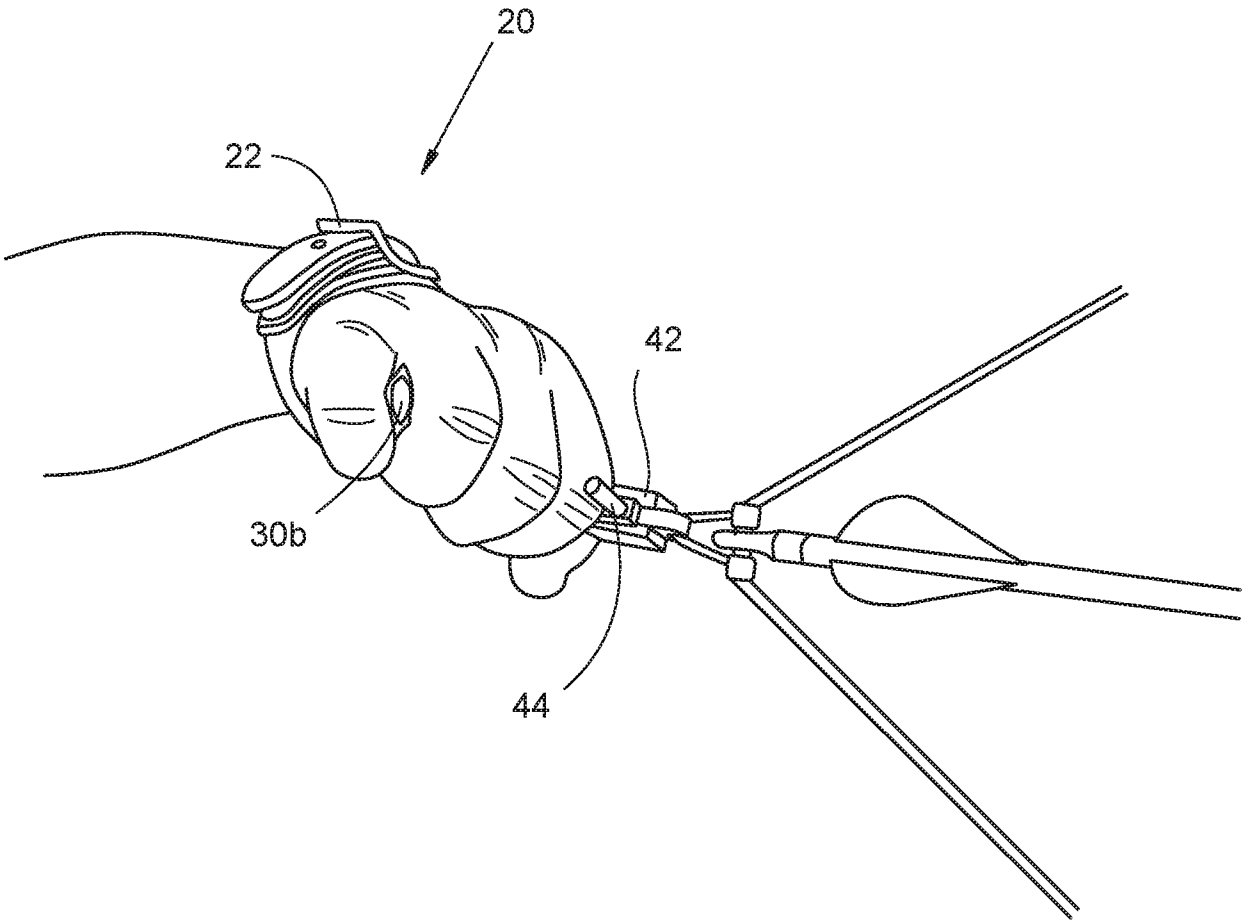
FIG. 5 is a schematic view perspective view of the example of FIG. 1 on the user's wrist, in the first relative configuration, engaging the drawn bowstring, and with the handgrip grasped by the user.

A method for drawing and shooting an archery bow comprises: placing the wrist strap 20 on the user's wrist; engaging the bowstring with the bowstring retention/release mechanism 42 of the release device 40; arranging in the first relative configuration the wrist strap 20, the release device 40, and the handgrip 30/30' (e.g., as in FIG. 3); grasping the release device 40 and the handgrip 30/30' (e.g., as in FIG. 4); pulling the bowstring with the wrist strap 20 and the handgrip 30/30' to draw the bow (e.g., as in FIG. 5); and, with the bow drawn, removing at least one finger from the grip portion(s) of the handgrip 30' and, using that finger, actuating the trigger mechanism, thereby releasing the bowstring and shooting the bow.

In some examples, the method further comprises, with the bow drawn, removing at least one finger from a grip portion of the handgrip 30/30' and, using that finger, actuating the trigger mechanism while leaving at least one finger grasping a grip portion of the handgrip 30/30'. In some such examples, the user actuates the trigger mechanism with his index finger while his middle and ring fingers remain grasping a grip portion of the handgrip 30/30'. A method in which one or more fingers remain grasping the handgrip 30/30' can be performed regardless of whether the handgrip 30/30' is pivotably or substantially rigidly connected to the wrist strap 20.

In some other examples, the method further comprises, with the bow drawn: removing all fingers from the grip portion(s) of the handgrip 30/30' (e.g., as in FIG. 6); using at least one finger to move the handgrip 30/30' to the second relative configuration; and using at least one finger to actuate the trigger mechanism, thereby releasing the bowstring and shooting the bow. In some such examples, with the handgrip 30/30' in the second relative configuration, the wrist strap 20, the release device 40, and the handgrip 30/30' are arranged so that the user can actuate the trigger mechanism without making contact with the grip portion(s) of the handgrip 30/30'. A method in which all fingers are removed from the handgrip 30/30' after drawing the bow but before shooting it can also be employed using a bowstring draw/ release apparatus 10 in which the handgrip 30 is substantially rigidly connected to the wrist strap 20.

The ability choose whether or not to continue to grip the handgrip 30/30' after drawing the bow or while actuating the trigger mechanism, and the ability to move the handgrip 30/30' between the first and second relative configurations, enables the archer to choose among a wider array of differing methods for drawing and shooting the archery bow using the bowstring draw/release apparatus 10. The ability to choose whether to grip or to move the handgrip 30/30' after the bow is drawn enables that choice to be made after the bow is drawn but before it is shot.

In addition to the preceding, the following examples fall within the scope of the present disclosure or appended claims:

Example 1

A bowstring draw/release apparatus comprising: (a) a wrist strap including a dorsal-wrist portion and a heel portion; (b) a bowstring release device pivotably connected at a rearward end thereof to the heel portion of the wrist strap, said release device having a bowstring retention/release mechanism at a forward end thereof and a trigger mechanism operationally coupled to the retention/release mechanism; and (c) a handgrip having substantially rigid grip and coupler portions that are substantially rigidly connected to each other with the handgrip being pivotably connected at a rearward end of the coupler portion to the release device or the heel portion of the wrist strap, wherein: (d) a pivotable connection of the release device to the heel portion of the wrist strap is structurally arranged so as to enable the release device to pivot relative to the wrist strap with the wrist strap engaged about a user's wrist; (e) a pivotable connection of the handgrip to the release device or the heel portion of the wrist strap is structurally arranged so as to enable the handgrip to pivot relative to the release mechanism or the wrist strap or both with the wrist strap engaged about a user's wrist; (f) the grip portion of the handgrip is connected to the bowstring draw/release apparatus only by connection of said grip portion to the coupler portion of the handgrip; (g) with the wrist strap, the release device, and the handgrip in a first relative configuration, the grip portion of the handgrip extends transversely away from the release device; and (h) with the wrist strap, the release device, and the handgrip in a second relative configuration, the grip portion of the handgrip extends obliquely rearward away from the release device.

Example 2

The bowstring draw/release apparatus of Example 1 wherein the grip portion of the handgrip includes one or more depressions on a forward edge thereof that are structurally arranged so as to receive in each of the one or more depressions a corresponding finger of the user's hand.

Example 3

The bowstring draw/release apparatus of any one of Examples 1 or 2 wherein the heel portion of the wrist strap includes a substantially rigid plate attached thereto, and one or both of the release device or the coupler portion of the handgrip are connected to the heel portion of the wrist strap by being connected to the rigid plate.

Example 4

The bowstring draw/release apparatus of any one of Examples 1 through 3 wherein the grip portion of the handgrip includes padding material.

Example 5

The bowstring draw/release apparatus of any one of Examples 1 through 4 wherein the dorsal-wrist portion of the wrist strap comprises separate strap segments and a closure mechanism structurally arranged to join the separate strap segments.

Example 6

The bowstring draw/release apparatus of any one of Examples 1 through 5 wherein: (g') with the wrist strap, the release device, and the handgrip in the first relative configuration, a medial portion of the grip portion of the handgrip extends transversely away from the release device on a first side of the release device and a lateral portion of the grip portion of the handgrip extends transversely away from the release device on a second side of the release device opposite the first side; and (h') with the wrist strap, the release device, and the handgrip in the second relative configuration, the lateral grip portion and at least part of the medial grip portion extend obliquely rearward away from the release device on the second side of the release device.

Example 7

The bowstring draw/release apparatus of Example 6 wherein, with the wrist strap on the user's wrist and with the wrist strap, the release device, and the handgrip in the first relative configuration, the wrist strap, the release device, and the handgrip are arranged so that, simultaneously, (i) the release device can extend forward between the user's index and middle fingers, (ii) the user's index finger can grasp the medial grip portion, and (iii) at least the user's middle finger can grasp the lateral grip portion.

Example 8

The bowstring draw/release apparatus of Example 7 wherein, with the wrist strap on the user's wrist and with the wrist strap, the release device, and the handgrip in the first relative configuration, the wrist strap, the release device, and the handgrip are arranged so that, simultaneously, (i) the release device can extend forward between the user's index and middle fingers, (ii) the user's index finger can grasp the medial grip portion, and (iii) the user's middle, ring, and little fingers can grasp the lateral grip portion.

Example 9

The bowstring draw/release apparatus of any one of Examples 6 through 8 wherein, with the wrist strap on a user's wrist and with the wrist strap, the release device, and the handgrip in the second relative configuration, the wrist strap, the release device, and the handgrip are arranged so that the user can actuate the trigger mechanism without making contact with the grip portion of the handgrip.

Example 10

A method for using an archery bow using the bowstring draw/release apparatus of any one of Examples 6 through 9, the method comprising: (A) placing on the user's wrist the wrist strap; (B) engaging a bowstring of the archery bow with the bowstring release device; (C) arranging in the first relative configuration the wrist strap, the release device, and the handgrip; (D) grasping the release device and the handgrip so that, simultaneously, (i) the release device extends forward between the user's index and middle fingers, (ii) the user's index finger grasps the medial grip portion, and (iii) at least the user's middle finger grasps the lateral grip portion; (E) pulling the bowstring with the wrist strap and the handgrip to draw the bow; and (F) with the bow drawn, removing at least one finger from the grip portion of the handgrip and, using that finger, actuating the trigger mechanism.

Example 11

The method of Example 10 further comprising, with the bow drawn, removing all fingers from the grip portion before actuating the trigger mechanism.

Example 12

The method of Example 11 further comprising, after removing all fingers from the grip portion and before actuating the trigger mechanism, using at least one finger, moving the handgrip from the first relative configuration to the second relative configuration.

Example 13

The method of any one of Examples 10 through 12 wherein, with the wrist strap on the user's wrist and with the wrist strap, the release device, and the handgrip in the second relative configuration, the wrist strap, the release device, and the handgrip are arranged so that the user can actuate the trigger mechanism without making contact with the grip portion of the handgrip.

Example 14

The bowstring draw/release apparatus of any one of Examples 1 through 5 wherein: (g') with the wrist strap, the release device, and the handgrip in the first relative configuration, the grip portion of the handgrip extends transversely away from the release device on only one side of the release device; and (h') with the wrist strap, the release device, and the handgrip in the second relative configuration, the grip portion extends obliquely rearward away from the release device on only one side of the release device with the grip portion of the handgrip is spaced apart from the release device.

Example 15

The bowstring draw/release apparatus of Example 14 wherein, with the wrist strap on the user's wrist and with the wrist strap, the release device, and the handgrip in the first relative configuration, the wrist strap, the release device, and the handgrip are arranged so that, simultaneously, (i) the release device can extend forward between the user's thumb and index finger and (ii) at least the user's index and middle fingers can grasp the grip portion.

Example 16

The bowstring draw/release apparatus of Example 15 wherein, with the wrist strap on the user's wrist and with the wrist strap, the release device, and the handgrip in the first relative configuration, the wrist strap, the release device, and the handgrip are arranged so that, simultaneously, (i) the release device can extend forward between the user's thumb and index finger and (ii) at least the user's index, middle, and ring fingers can grasp the grip portion.

Example 17

The bowstring draw/release apparatus of any one of Examples 14 through 16 wherein, with the wrist strap on a user's wrist and with the wrist strap, the release device, and the handgrip in the second relative configuration, the wrist strap, the release device, and the handgrip are arranged so that the user can actuate the trigger mechanism without making contact with the grip portion of the handgrip.

Example 18

A method for using an archery bow using the bowstring draw/release apparatus of any one of Examples 14 through 17, the method comprising: (A) placing on the user's wrist the wrist strap; (B) engaging a bowstring of the archery bow with the bowstring release device; (C) arranging in the first relative configuration the wrist strap, the release device, and the handgrip; and (D) grasping the release device and the handgrip so that, simultaneously, (i) the release device extends forward between the user's thumb and index finger and (ii) at least the user's index and middle fingers grasp the grip portion of the handgrip; (E) pulling the bowstring with the wrist strap and the handgrip to draw the bow; and (F) with the bow drawn, removing at least one finger from the grip portion of the handgrip and, using that finger, actuating the trigger mechanism.

Example 19

The method of Example 18 further comprising, with the bow drawn, removing all fingers from the grip portion and then actuating the trigger mechanism, thereby releasing the bowstring and shooting the bow.

Example 20

The method of Example 19 further comprising, after removing all fingers from the grip portion and before actuating the trigger mechanism, using at least one finger, moving the handgrip from the first relative configuration to the second relative configuration.

Example 21

The method of any one of Examples 18 through 20 wherein, with the wrist strap on the user's wrist and with the wrist strap, the release device, and the handgrip in the second relative configuration, the wrist strap, the release device, and the handgrip are arranged so that the user can actuate the trigger mechanism without making contact with the grip portion of the handgrip.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise. For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

In the appended claims, any labelling of elements, steps, limitations, or other portions of a claim (e.g., (a), (b), (c), etc., or (i), (ii), (iii), etc.) is only for purposes of clarity, and shall not be construed as implying any sort of ordering or precedence of the claim portions so labelled. If any such ordering or precedence is intended, it will be explicitly recited in the claim or, in some instances, it will be implicit or inherent based on the specific content of the claim. In the appended claims, if the provisions of 35 USC §112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A bowstring draw/release apparatus comprising:

(a) a wrist strap including a dorsal-wrist portion and a heel portion;

(b) a bowstring release device pivotably connected at a rearward end thereof to the heel portion of the wrist strap, said release device having a bowstring retention/release mechanism at a forward end thereof and a trigger mechanism operationally coupled to the retention/release mechanism; and (c) a handgrip having substantially rigid grip and coupler portions that are substantially rigidly connected to each other with the handgrip being pivotably connected at a rearward end of the coupler portion to the release device or the heel portion of the wrist strap, wherein:

(d) a pivotable connection of the release device to the heel portion of the wrist strap is structurally arranged so as to enable the release device to pivot relative to the wrist strap with the wrist strap adapted to be engaged about a user's wrist;

(e) a pivotable connection of the handgrip to the release device or the heel portion of the wrist strap is structurally arranged so as to enable the handgrip to pivot relative to both the release mechanism and the wrist strap with the wrist strap adapted to be engaged about a user's wrist;

(f) the grip portion of the handgrip is connected to the bowstring draw/release apparatus only by connection of said grip portion to the coupler portion of the handgrip;

(g) with the wrist strap, the release device, and the handgrip in a first relative configuration, the grip portion of the handgrip extends transversely away from the release device;

(h) with the wrist strap, the release device, and the handgrip in a second relative configuration, the grip portion of the handgrip extends obliquely rearward away from the release device; and (i) with the wrist strap adapted to be engaged about a user's wrist, and with the retention/release mechanism engaged with and under tension from a bowstring of a drawn archery bow, the handgrip is moveable relative to the engaged bowstring between the first and second relative configurations.

2. The bowstring draw/release apparatus of claim 1 wherein the grip portion of the handgrip includes one or more depressions on a forward edge thereof that are structurally arranged so as to receive in each of the one or more depressions a corresponding finger of the user's hand.

3. The bowstring draw/release apparatus of claim 1 wherein:

(g') with the wrist strap, the release device, and the handgrip in the first relative configuration, a medial portion of the grip portion of the handgrip extends transversely away from the release device on a first side of the release device and a lateral portion of the grip portion of the handgrip extends transversely away from the release device on a second side of the release device opposite the first side; and (h') with the wrist strap, the release device, and the handgrip in the second relative configuration, the lateral grip portion and at least part of the medial grip portion extend obliquely rearward away from the release device on the second side of the release device.

4. The bowstring draw/release apparatus of claim 3 wherein, with the wrist strap adapted to be engaged with the user's wrist and with the wrist strap, the release device, and the handgrip in the first relative configuration, the wrist strap, the release device, and the handgrip are arranged so that, simultaneously, (i) the release device can extend forward between the user's index and middle fingers, (ii) the user's index finger can grasp the medial grip portion, and (iii) at least the user's middle finger can grasp the lateral grip portion.

5. The bowstring draw/release apparatus of claim 4 wherein, with the wrist strap adapted to be engaged with the user's wrist and with the wrist strap, the release device, and the handgrip in the first relative configuration, the wrist strap, the release device, and the handgrip are arranged so that, simultaneously, (i) the release device can extend forward between the user's index and middle fingers, (ii) the user's index finger can grasp the medial grip portion, and (iii) the user's middle, ring, and little fingers can grasp the lateral grip portion.

6. The bowstring draw/release apparatus of claim 4 wherein, with the wrist strap adapted to be engaged with the user's wrist and with the wrist strap, the release device, and the handgrip in the second relative configuration, the wrist strap, the release device, and the handgrip are arranged so that the user can actuate the trigger mechanism without making contact with the grip portion of the handgrip.

7. A method for using an archery bow using the bowstring draw/release apparatus of claim 4, the method comprising:

(A) placing the wrist strap on the user's wrist and engaging the wrist strap with the user's wrist;

(B) engaging a bowstring of the archery bow with the bowstring release device;

(C) arranging in the first relative configuration the wrist strap, the release device, and the handgrip;

(D) grasping the release device and the handgrip so that, simultaneously, (i) the release device extends forward between the user's index and middle fingers, (ii) the user's index finger grasps the medial grip portion, and (iii) at least the user's middle finger grasps the lateral grip portion;

(E) pulling the bowstring with the wrist strap and the handgrip to draw the bow; and (F) with the bow drawn, removing at least one finger from the grip portion of the handgrip and, using that finger, actuating the trigger mechanism, thereby releasing the bowstring and shooting the bow.

8. The method of claim 7 further comprising, with the bow drawn, removing all fingers from the grip portion before actuating the trigger mechanism.

9. The method of claim 8 further comprising, after removing all fingers from the grip portion and before actuating the trigger mechanism, using at least one finger, moving the handgrip from the first relative configuration to the second relative configuration.

10. The method of claim 9 wherein, with the wrist strap on the user's wrist and with the wrist strap, the release device, and the handgrip in the second relative configuration, the wrist strap, the release device, and the handgrip are arranged so that the user can actuate the trigger mechanism without making contact with the grip portion of the handgrip.

11. The bowstring draw/release apparatus of claim 1 wherein:

(g') with the wrist strap, the release device, and the handgrip in the first relative configuration, the grip portion of the handgrip extends transversely away from the release device on only one side of the release device; and (h') with the wrist strap, the release device, and the handgrip in the second relative configuration, the grip portion extends obliquely rearward away from the release device on only one side of the release device with the grip portion of the handgrip is spaced apart from the release device.

12. The bowstring draw/release apparatus of claim 11 wherein, with the wrist strap adapted to be engaged with the user's wrist and with the wrist strap, the release device, and the handgrip in the first relative configuration, the wrist strap, the release device, and the handgrip are arranged so that, simultaneously, (i) the release device can extend forward between the user's thumb and index finger and (ii) at least the user's index and middle fingers can grasp the grip portion.

13. The bowstring draw/release apparatus of claim 12 wherein, with the wrist strap adapted to be engaged with the user's wrist and with the wrist strap, the release device, and the handgrip in the first relative configuration, the wrist strap, the release device, and the handgrip are arranged so that, simultaneously, (i) the release device can extend forward between the user's thumb and index finger and (ii) at least the user's index, middle, and ring fingers can grasp the grip portion.

14. The bowstring draw/release apparatus of claim 12 wherein, with the wrist strap adapted to be engaged with the user's wrist and with the wrist strap, the release device, and the handgrip in the second relative configuration, the wrist strap, the release device, and the handgrip are arranged so that the user can actuate the trigger mechanism without making contact with the grip portion of the handgrip.

15. A method for using an archery bow using the bowstring draw/release apparatus of claim 12, the method comprising:

(A) placing the wrist strap on the user's wrist and engaging the wrist strap with the user's wrist;

(B) engaging a bowstring of the archery bow with the bowstring release device;

(C) arranging in the first relative configuration the wrist strap, the release device, and the handgrip; and (D) grasping the release device and the handgrip so that, simultaneously, (i) the release device extends forward between the user's thumb and index finger and (ii) at least the user's index and middle fingers grasp the grip portion of the handgrip;

(E) pulling the bowstring with the wrist strap and the handgrip to draw the bow; and (F) with the bow drawn, removing at least one finger from the grip portion of the handgrip and, using that finger, actuating the trigger mechanism, thereby releasing the bowstring and shooting the bow.

16. The method of claim 15 further comprising, with the bow drawn, removing all fingers from the grip portion before actuating the trigger mechanism.

17. The method of claim 16 further comprising, after removing all fingers from the grip portion and before actuating the trigger mechanism, using at least one finger, moving the handgrip from the first relative configuration to the second relative configuration.

18. The method of claim 17 wherein, with the wrist strap on the user's wrist and with the wrist strap, the release device, and the handgrip in the second relative configuration, the wrist strap, the release device, and the handgrip are arranged so that the user can actuate the trigger mechanism without making contact with the grip portion of the handgrip.

* * * * *